US010863263B2

(12) United States Patent
Ogura et al.

(10) Patent No.: US 10,863,263 B2
(45) Date of Patent: Dec. 8, 2020

(54) ACOUSTIC LENS AND SPEAKER SYSTEM

(71) Applicant: Panasonic Intellectual Property Management Co., Ltd., Osaka (JP)

(72) Inventors: Takashi Ogura, Osaka (JP); Shohei Kawagoe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/344,038

(22) PCT Filed: Jan. 17, 2018

(86) PCT No.: PCT/JP2018/001108
§ 371 (c)(1),
(2) Date: Apr. 23, 2019

(87) PCT Pub. No.: WO2018/150788
PCT Pub. Date: Aug. 23, 2018

(65) Prior Publication Data

US 2019/0253792 A1 Aug. 15, 2019

(30) Foreign Application Priority Data

Feb. 20, 2017 (JP) ..... 2017-029312

(51) Int. Cl.
*H04R 1/34* (2006.01)
*H04R 1/02* (2006.01)

(52) U.S. Cl.
CPC ..... *H04R 1/34* (2013.01); *H04R 1/02* (2013.01); *H04R 1/345* (2013.01)

(58) Field of Classification Search
CPC ..... H04R 1/34; H04R 1/345; H04R 1/02
See application file for complete search history.

(56) References Cited

U.S. PATENT DOCUMENTS

2011/0168480 A1* 7/2011 Sterling ..... H04R 1/023 181/176
2015/0319515 A1* 11/2015 Devantier ..... H04R 1/02 381/345

FOREIGN PATENT DOCUMENTS

JP 53-006632 U 1/1978
JP 64-030399 2/1989
JP 8-331684 12/1996

OTHER PUBLICATIONS

International Search Report of PCT application No. PCT/JP2018/001108 dated Mar. 20, 2018.

* cited by examiner

*Primary Examiner* — Sunita Joshi
(74) *Attorney, Agent, or Firm* — McDermott Will & Emery LLP

(57) ABSTRACT

Acoustic lens includes a plurality of fins arranged at a predetermined interval. At least one fin among the plurality of fins includes: first notch portion provided on a front side of a path of a sound; and second notch portion provided on a rear side of the path of the sound. Second notch portion has a shape corresponding to a shape of a diaphragm of a speaker disposed in proximity to the fin.

12 Claims, 18 Drawing Sheets

ACOUSTIC LENS AND SPEAKER SYSTEM

CROSS-REFERENCE TO RELATED APPLICATIONS

This application is a U.S. national stage application of the PCT International Application No. PCT/JP2018/001108 filed on Jan. 17, 2018, which claims the benefit of foreign priority of Japanese patent application No. 2017-029312 filed on Feb. 20, 2017, the contents all of which are incorporated herein by reference.

TECHNICAL FIELD

The present disclosure relates to an acoustic lens that adjusts directivity of a sound, and to a speaker system including the acoustic lens.

BACKGROUND ART

A propagation distance of a sound wave output from a diaphragm changes by a solid obstacle. The sound wave of which propagation distance has changed by the solid obstacle and the sound wave directly radiated from the diaphragm differ from each other in time of being radiated to a space. Therefore, both differ from each other in apparent velocity of sound, and as a result, the sound wave is refracted in a direction where a path is longer. An acoustic lens is a device using this phenomenon and for diffusing a propagation direction of the sound wave (for example, refer to PTL 1).

Such an acoustic lens is disposed in front of a tweeter having strong sound straightness, whereby a sound field spreads horizontally, and a listening area can be expanded.

CITATION LIST

Patent Literature

PTL 1: Unexamined Japanese Patent Publication No. H08-331684

SUMMARY OF THE INVENTION

The present disclosure provides an acoustic lens that adjusts directivity of a speaker. Moreover, the present disclosure provides a speaker system including the acoustic lens.

In a first aspect of the present disclosure, a first acoustic lens that adjusts directivity of a sound emitted from a speaker is provided. The first acoustic lens includes a plurality of fins arranged at a predetermined interval. A first fin that is one of the plurality of fins at least includes: a first notch portion provided on a front side of a path of the sound; and a second notch portion provided on a rear side of the path of the sound. The second notch portion has a shape corresponding to a shape of a diaphragm of the speaker, the diaphragm being disposed in proximity to the first fin.

In a second aspect of the present disclosure, a second acoustic lens that adjusts directivity of a sound emitted from a speaker is provided. The second acoustic lens includes a plurality of fins arranged at a predetermined interval. The plurality of fins are arranged parallel to a direction perpendicular to a longitudinal direction of the plurality of fins. A notch portion is formed on a front side of a path of the sound in each of the plurality of fins. A shape of each of the plurality of fins is asymmetrical in the longitudinal direction.

In a third aspect of the present disclosure, there is provided a speaker system including: the speaker that outputs the sound; and one of the first and second acoustic lenses, the one acoustic lens being disposed on the path of the sound emitted from the speaker.

The present disclosure provides an acoustic lens that expands a listening area, and a speaker system including such an acoustic lens.

DESCRIPTION OF EMBODIMENTS

Hereinafter, exemplary embodiments will be described in detail with reference to the drawings as appropriate. However, detailed descriptions more than necessary may be omitted. For example, a detailed description of a matter which is already well-known, or a repetitive description for a substantially identical configuration may be omitted. This is to avoid unnecessarily redundancy in the following description, and to facilitate understanding by those skilled in the art.

The inventors provide the accompanying drawings and the following description to help those skilled in the art sufficiently understand the present disclosure, and therefore have no intention to put any limitation by those drawings and description on subject matters described in claims.

Hereinafter, specific exemplary embodiments of a speaker system of the present disclosure will be described with reference to the accompanying drawings.

First Exemplary Embodiment

1-1. General Configuration of Speaker System

Figure 1:
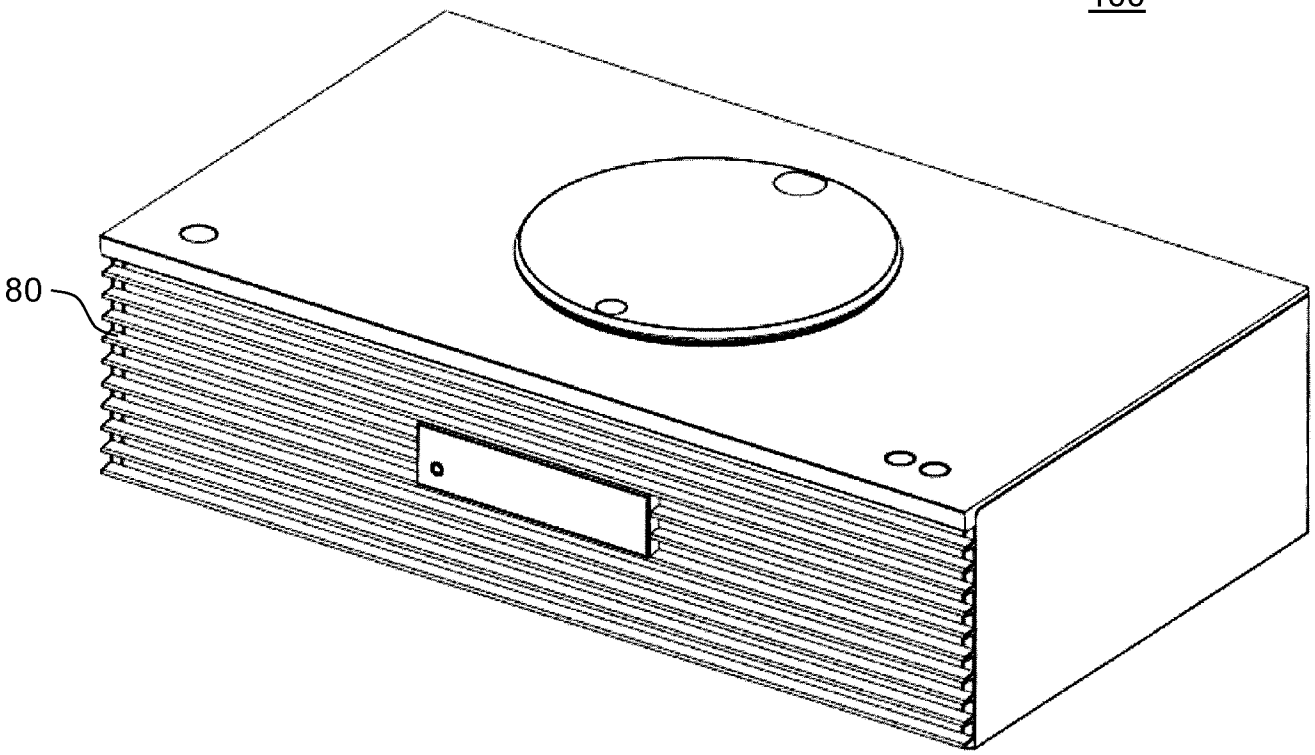
FIG. 1 is a perspective view of a speaker system including an acoustic lens according to an exemplary embodiment of the present disclosure.

FIG. 1 is a perspective view of a speaker system including an acoustic lens according to an exemplary embodiment of the present disclosure. Speaker system 100 receives a sound signal in a wired or wireless manner, and outputs a sound based on the sound signal. Speaker system 100 according to the present exemplary embodiment is a compact speaker having a width of approximately 40 cm. Note that the width is defined to be a length in a longitudinal direction. Moreover, the longitudinal direction of the acoustic lens according to the present exemplary embodiment is parallel to the horizontal direction. Therefore, the acoustic lens is required to spread the sound in the horizontal direction (that is, the longitudinal direction of the speaker).

Figure 2:
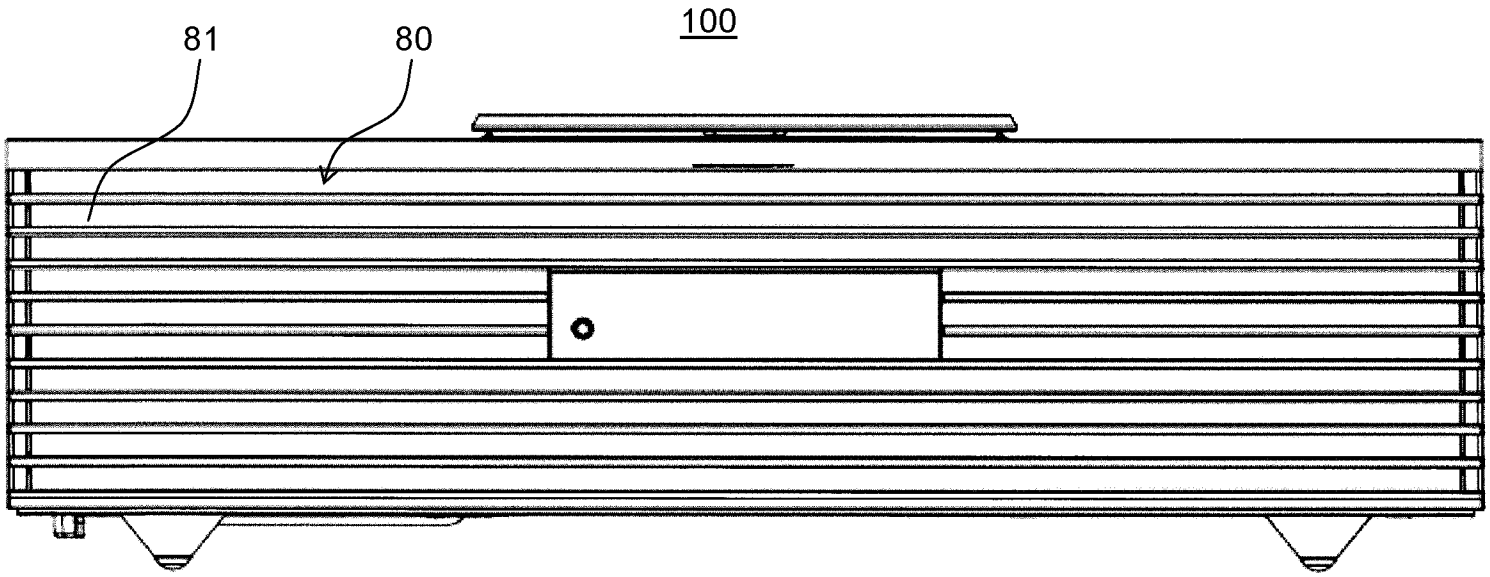
FIG. 2 is a front view of the speaker system.

FIG. 2 is a front view of speaker system 100. Speaker system 100 includes louver 80 on a front face. Louver 80 includes a plurality of louver boards 81. The plurality of louver boards 81 are arranged parallel to one another at a predetermined interval. Each of the plurality of louver boards 81 has a flat plate shape. The sound from speaker system 100 is output to the outside from each space between louver boards 81 and 81.

Figure 3:
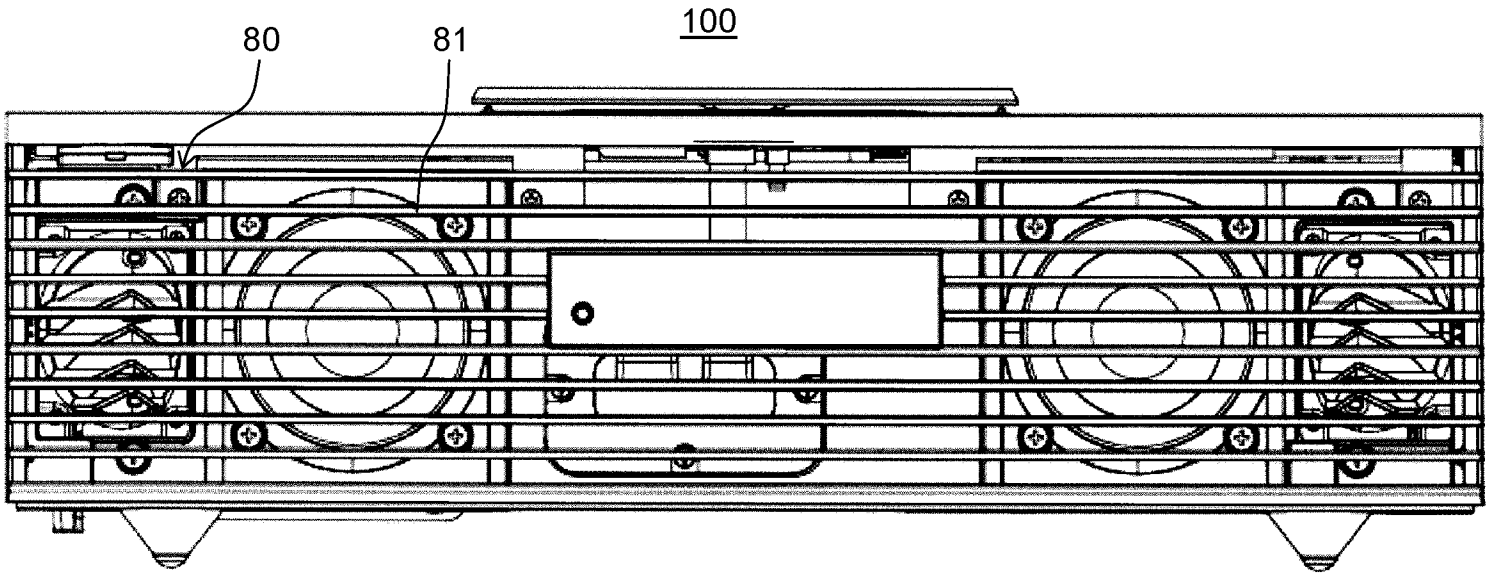
FIG. 3 is a front view of the speaker system in a state where a speaker net is detached.

Speaker system 100 includes a speaker net attached inward from louver 80. Speaker net is attached for the purpose of subjecting speaker units to hiding, dust prevention, protection and the like. FIG. 3 is a front view of speaker system 100 in a state where the speaker net is detached. The speaker net is installed so as not to disturb a primary sound emitted from the speaker. Generally, the speaker net is formed of cloth having high air permeability.

Figure 4:
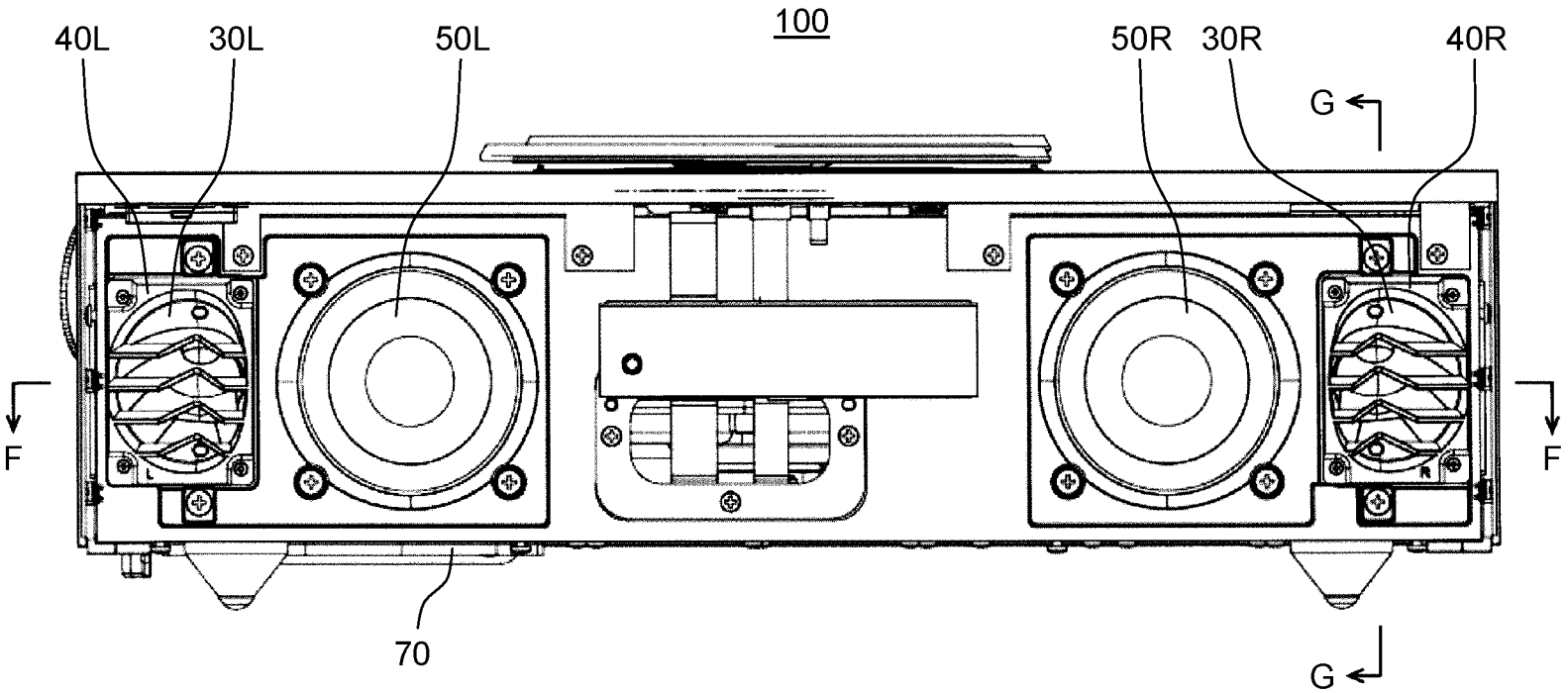
FIG. 4 is a front view of the speaker system in a state where a louver and the speaker net are detached.

FIG. 4 is a front view of speaker system 100 when louver 80 is further detached from a state illustrated in FIG. 3. On a front face (that is, the front side) of speaker system 100, and on a left side on the drawing, there are disposed: Lch tweeter 30L that outputs a sound at a high frequency; and Lch midrange speaker 50L that outputs a sound at a middle range frequency. Moreover, on the front face (that is, the front side) of speaker system 100, and on a right side on the drawing, there are disposed: Rch tweeter 30R that outputs a sound at the high frequency; and Rch midrange speaker 50R that outputs a sound at the middle range frequency. Tweeters 30L, 30R are disposed on outsides of midrange speakers 50L, 50R (that is, on sides close to ends of speaker system 100).

Moreover, woofer 70 that outputs a sound at a low frequency is disposed on a bottom face of speaker system 100. Woofer 70 is disposed to face downward. As described above, speaker system 100 is a 3-way speaker system provided with the speakers in charge of respective audio frequencies which are the high, middle range and low frequencies.

As illustrated in FIGS. 3 and 4, acoustic lenses 40L, 40R are respectively mounted on tweeters 30L, 30R. Acoustic lenses 40L, 40R are devices for expanding listening ranges of the sounds, which are output from tweeters 30L, 30R, in the horizontal direction (that is, the longitudinal direction) of speaker system 100.

Figure 5:
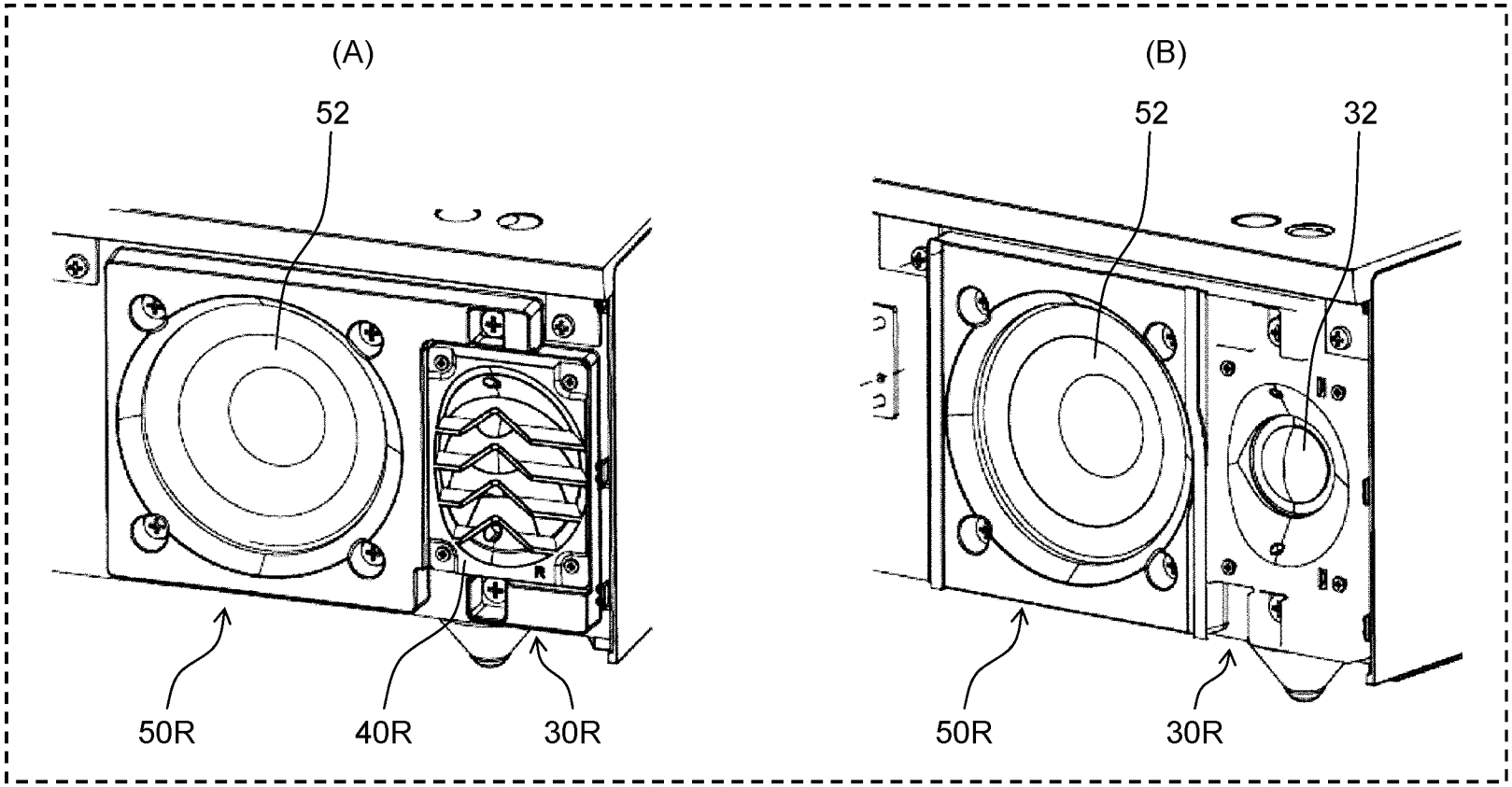
FIG. 5 is a view illustrating (A) a view where a portion of a midrange speaker and a tweeter attached with an acoustic lens in the speaker system is enlarged, and (B) a view where a portion of the midrange speaker and the tweeter without the acoustic lens in the speaker system is enlarged.

A part (A) of FIG. 5 is a view illustrating an enlarged portion of Rch midrange speaker 50R and Rch tweeter 30R attached with acoustic lens 40R in speaker system 100. A part (B) of FIG. 5 is a view illustrating a state where acoustic lens 40R is detached from a state of (A) of FIG. 5, and dome-shaped diaphragm 32 of Rch tweeter 30R is exposed. A path of a sound wave generated by vibrations of diaphragm 32 of Rch tweeter 30R is changed by acoustic lens 40R, and the sound wave propagates to the outside of speaker system 100. Hereinafter, details of acoustic lenses 40L, 40R will be described.

1-2. Acoustic Lens

As mentioned above, speaker system 100 according to the present exemplary embodiment is a compact device, and is required to spread the sound. In the present exemplary embodiment, acoustic lenses 40L, 40R are attached to tweeters 30L, 30R, whereby the spread (diffusion) of the sounds at the high frequency in the horizontal direction is achieved. The acoustic lens is a known technique for expanding a propagation range of a sound. Herein, in order to further expand the propagation range of the sound, a distance difference between paths only needs to be increased. However, in this case, the acoustic lens is increased in size. The speaker system according to the present exemplary embodiment is compact, and it is difficult to mount large acoustic lenses on the speaker system. In contrast, acoustic lenses 40L, 40R according to the present exemplary embodiment have configurations in which such propagation ranges of the sounds can be further expanded even if acoustic lenses 40L, 40R are compact. Hereinafter, the configurations of such acoustic lenses 40L, 40R will be described. Note that, since acoustic lens 40L for Lch and acoustic lens 40R for Rch have bilaterally symmetrical configurations, the configuration of only acoustic lens 40R for the Rch will be described below for convenience of explanation.

Figure 6:
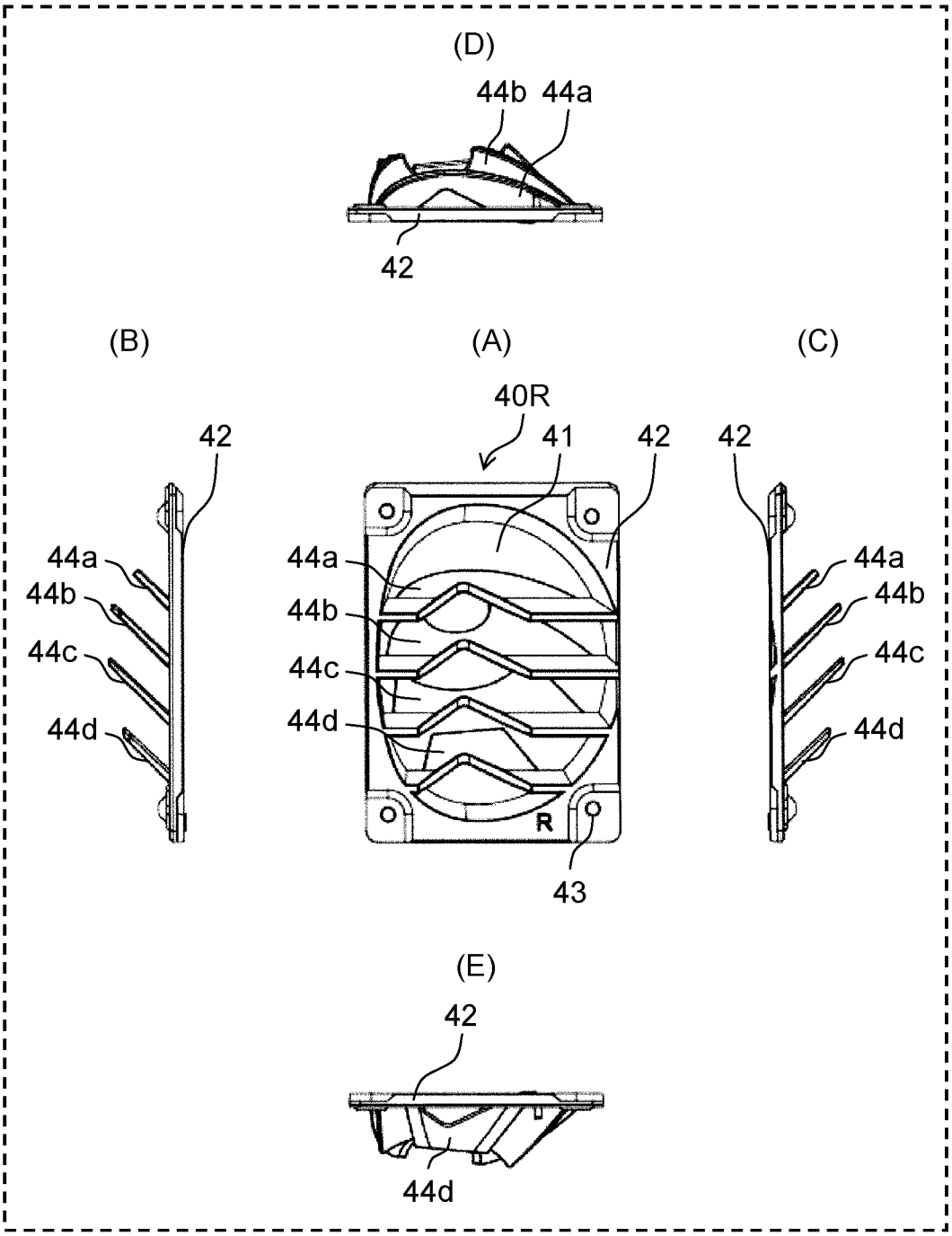
FIG. 6 is a view illustrating (A) a front view of the acoustic lens, (B) a left side view of the acoustic lens, (C) a right side view of the acoustic lens, (D) a top view of the acoustic lens, and (E) a bottom view of the acoustic lens.

Parts (A) to (E) of FIG. 6 are views illustrating the configuration of acoustic lens 40R. The part (A) of FIG. 6 is a front view of acoustic lens 40R. The part (B) of FIG. 6 is a left side view of acoustic lens 40R. The part (C) of FIG. 6 is a right side view of acoustic lens 40R. The part (D) of FIG. 6 is a top view of acoustic lens 40R. The part (E) of FIG. 6 is a bottom view of the acoustic lens.

As illustrated in the part (A) of FIG. 6, acoustic lens 40R includes: frame 42 having opening 41; and a plurality of fins (fins 44*a* to 44*d*) attached inside opening 41. Each of fins 44*a* to 44*d* has a flat plate shape. Screw holes 43 are provided at four corners of frame 42. Frame 42 is screwed and attached to a cabinet of the speaker system via these screw holes 43.

As illustrated in the parts (B) and (C) of FIG. 6, four fins (fins 44*a* to 44*d*) are arranged parallel to one another at a predetermined interval in a vertical direction. Each of fins 44*a* to 44*d* is attached to be inclined with respect to frame 42. Fins 44*a* to 44*d* have shapes different from one another. Hereinafter, the shapes of respective fins 44*a* to 44*d* will be described below.

Figure 7:
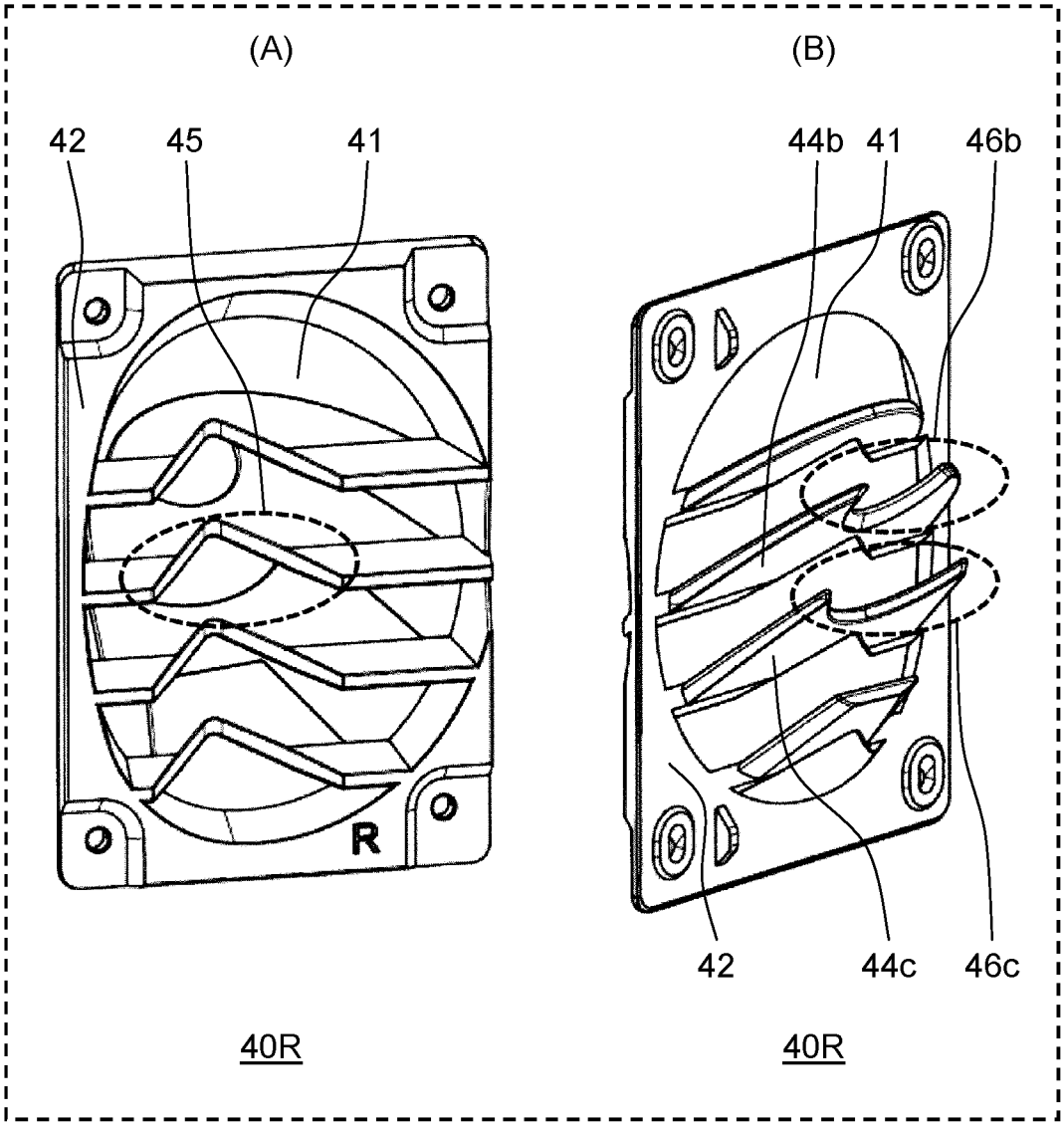
FIG. 7 is a view illustrating (A) a perspective view of the acoustic lens when viewed from front, and (B) a perspective view of the acoustic lens when viewed from behind.
Figure 8:
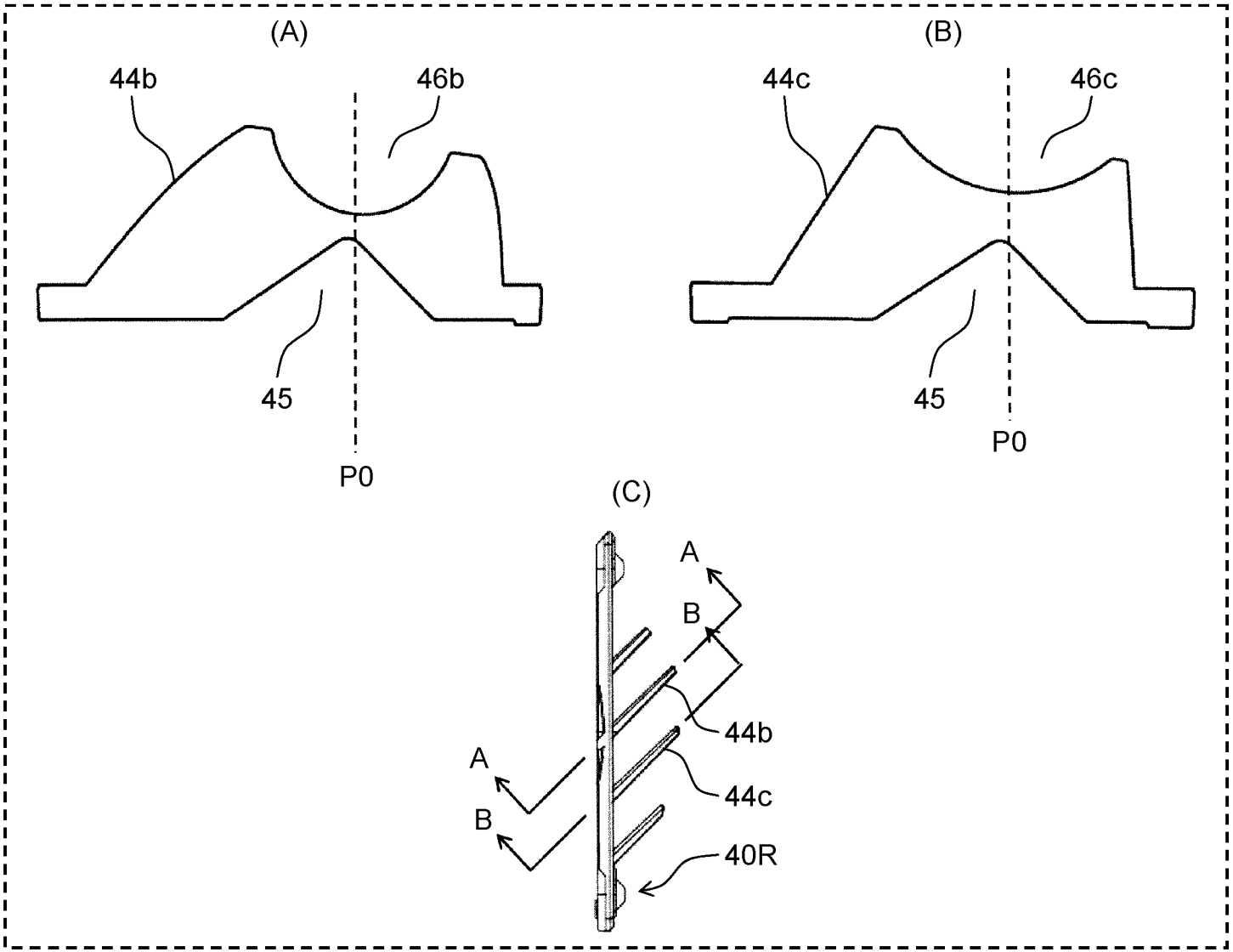
FIG. 8 is a view illustrating a relationship among (A) a cross section of a second fin of the acoustic lens, (B) a cross section of a third fin of the acoustic lens, and (C) a right side surface of the acoustic lens.

A part (A) of FIG. 7 is a perspective view when viewed from a front of acoustic lens 40R (that is, from a sound outlet side). A part (B) of FIG. 7 is a perspective view when viewed from a rear of acoustic lens 40R (that is, from a sound inlet side). A part (A) of FIG. 8 is a cross-sectional view of second fin 44*b* from a top in acoustic lens 40R, taken along line A-A illustrated in a part (C) of FIG. 8. Apart (B) of FIG. 8 is a cross-sectional view of third fin 44*c* from the top in acoustic lens 40R, taken along line B-B illustrated in the part (C) of FIG. 8.

A triangle notch portion 45 is provided on a front portion of each of fins 44*a* to 44*d*. This notch portion 45 can differentiate lengths of the paths where the sound wave propagates. Hence, a lens effect occurs, and a propagation direction of the sound wave can be refracted. Such an effect of refracting the propagation direction of the sound wave is referred to as an acoustic lens effect.

(Eccentric Fin)

In the present exemplary embodiment, the shape of each of fins 44*a* to 44*b* is bilaterally asymmetrical. This is for the purpose of diffusing the sound more in a direction toward one end of each of fins 44*a* to 44*d*, instead of diffusing the sound uniformly in the longitudinal direction of fins 44*a* to 44*d*.

For example, in the part (A) of FIG. 8, line P0 is a line passing through a horizontal center of diaphragm 32 of tweeter 30R on which acoustic lens 40R is mounted. Moreover, line P0 is a line perpendicular to the longitudinal direction of fin 44*b*. Fin 44*b* does not have a shape symmetrical with respect to this centerline P0. That is, the shape of fin 44*b* is asymmetrical in the longitudinal direction. Specifically, in FIG. 8, an area of a left portion of fin 44*b* from centerline P0 is larger than an area of a right portion of fin 44*b* from centerline P0. By such an asymmetrical shape of fin 44*b*, the path of the sound output from tweeter 30R and passing through a left portion of fin 44*b* is changed more largely than the path of the sound passing through a right portion of fin 44*b*, and the sound is strongly affected by a refraction effect of the acoustic lens. In this way, the sound from Rch tweeter 30R is output so as to be diffused at a relatively larger angle on the outside (right side when viewed from front) than on the inside (left side when viewed from front) with respect to speaker system 100.

As described above, the shape of notch portions 45 as the front portions of fins 44*a* to 44*d* is set so that the sound from tweeter 30R is diffused to a further outside in the horizontal direction of speaker system 100 (more rightward when viewed from front of speaker system 100). The same also applies to the Lch, and by acoustic lens 40L, the sound from Lch tweeter 30L is output while being diffused leftward of speaker system 100. As a result, a listening area in the horizontal direction of speaker system 100 can be expanded.

(Dome-Shaped Notch Portion)

Moreover, as illustrated in the parts (A) and (B) of FIG. 8, in fins 44*b*, 44*c* as parts in acoustic lens 40R, notch portions 46*b*, 46*c* are also provided in rear portions of fins 44*b*, 44*c*. Shapes of notch portions 46*b*, 46*c* are shapes corresponding to a shape of dome-shaped diaphragm 32 of tweeter 30R. That is, the shapes of notch portions 46*b*, 46*c* are shapes corresponding to at least one of a curved surface and an inclined surface, which constitutes an outer diameter of diaphragm 32. Note that, with regard to "the shapes corresponding to the shape of diaphragm 32", in a case where diaphragm 32 has a curved surface, it is not necessary that the shapes of notch portions 46*b*, 46*c* be shapes having completely the same curvature as a curvature of the curved surface of diaphragm 32. The shapes of notch portions 46*b*, 46*c* only need to be shapes each having a recess in a direction where the curved surface protrudes. Moreover, in a case where diaphragm 32 has the inclined surface, it is not necessary that the shapes of notch portions 46*b*, 46*c* only need to be shapes having completely the same inclination angle as an inclination angle of the inclined surface. The shapes of notch portions 46*b*, 46*c* only need to be shapes having inclination directions matching an inclination direction of diaphragm 32.

Figure 9:
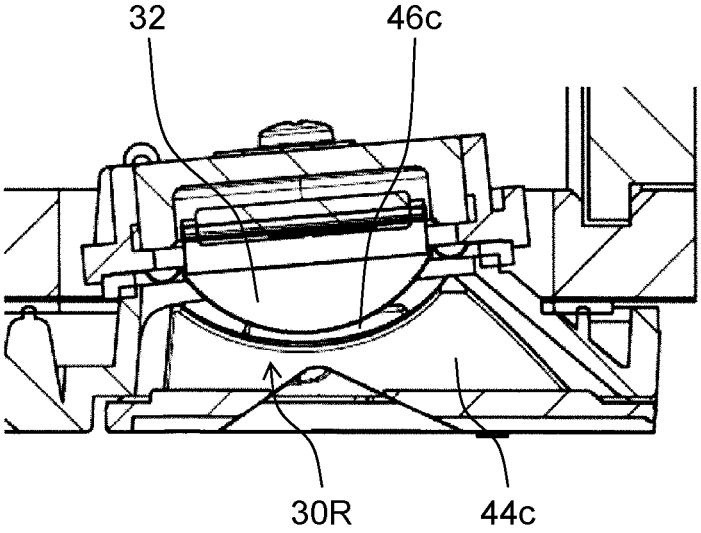
FIG. 9 is a sectional view (sectional view taken along line F-F in FIG. 4) of a portion of the tweeter in the speaker system.
Figure 10:
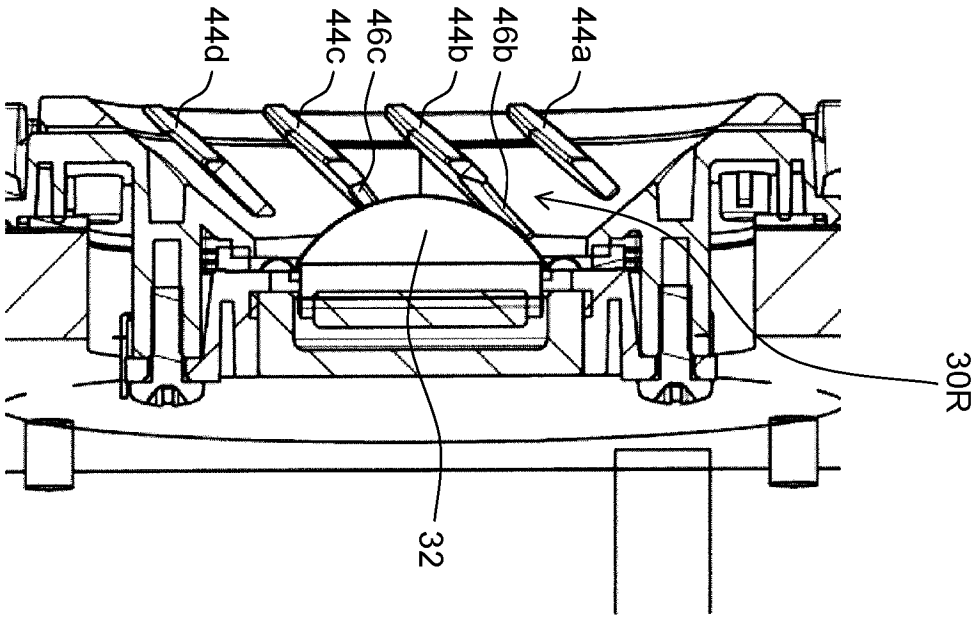
FIG. 10 is a cross-sectional view (cross section taken along line G-G in FIG. 4) of a portion of the tweeter in the speaker system.

FIG. 9 is a sectional view (sectional view taken along line F-F in FIG. 4) when a portion of tweeter 30R of speaker system 100 is cut in the horizontal direction. FIG. 10 is a cross-sectional view (cross-sectional view taken along line G-G in FIG. 4) when the portion of tweeter 30R of speaker system 100 is cut in the vertical direction. As illustrated in FIG. 9, diaphragm 32 of the tweeter is disposed to fit in notch portion 46*c* on the rear of fin 44*c* that is third from the top. Moreover, as illustrated in FIG. 10, diaphragm 32 is disposed to fit in notch portion 46*b* on the rear of fin 44*b* that is second from the top and in notch portion 46*c* on the rear of fin 44*c* that is the third from the top. Fins 44*b*, 44*c* and tweeter 30R are arranged at an interval, for example, of approximately 1 mm so that fins 44*b*, 44*c* and diaphragm 32 of tweeter 30R are not brought into contact with each other when diaphragm 32 vibrates. As described above, it is possible to dispose fins 44*b*, 44*c* in proximity to dome-shaped diaphragm 32 of tweeter 30R by notch portions 46*b*, 46*c* on the rear of fins 44*b*, 44*c*.

Generally, a frequency at start of control is inversely proportional to a length of a fin that forms a path of a sound. Hence, when the length of the fin is short, there is a problem that a sound at a low frequency cannot be controlled. In the present exemplary embodiment, it is possible to extend fins 44*b*, 44*c* to the proximity of diaphragm 32 of tweeter 30R. As a result, it is possible to ensure the paths, which are formed of fins 44*b*, 44*c*, to be longer. In this way, a controllable frequency can be shifted to a lower frequency (11 kHz in this example). That is, even in a case where a space for the fins is not ensured sufficiently due to miniaturization of the device, a degree of freedom in design can be increased since such a controllable frequency range can be expanded.

Measurement results of acoustic characteristics of acoustic lenses 40R and 40L configured as described above will be shown below.

Figure 11:
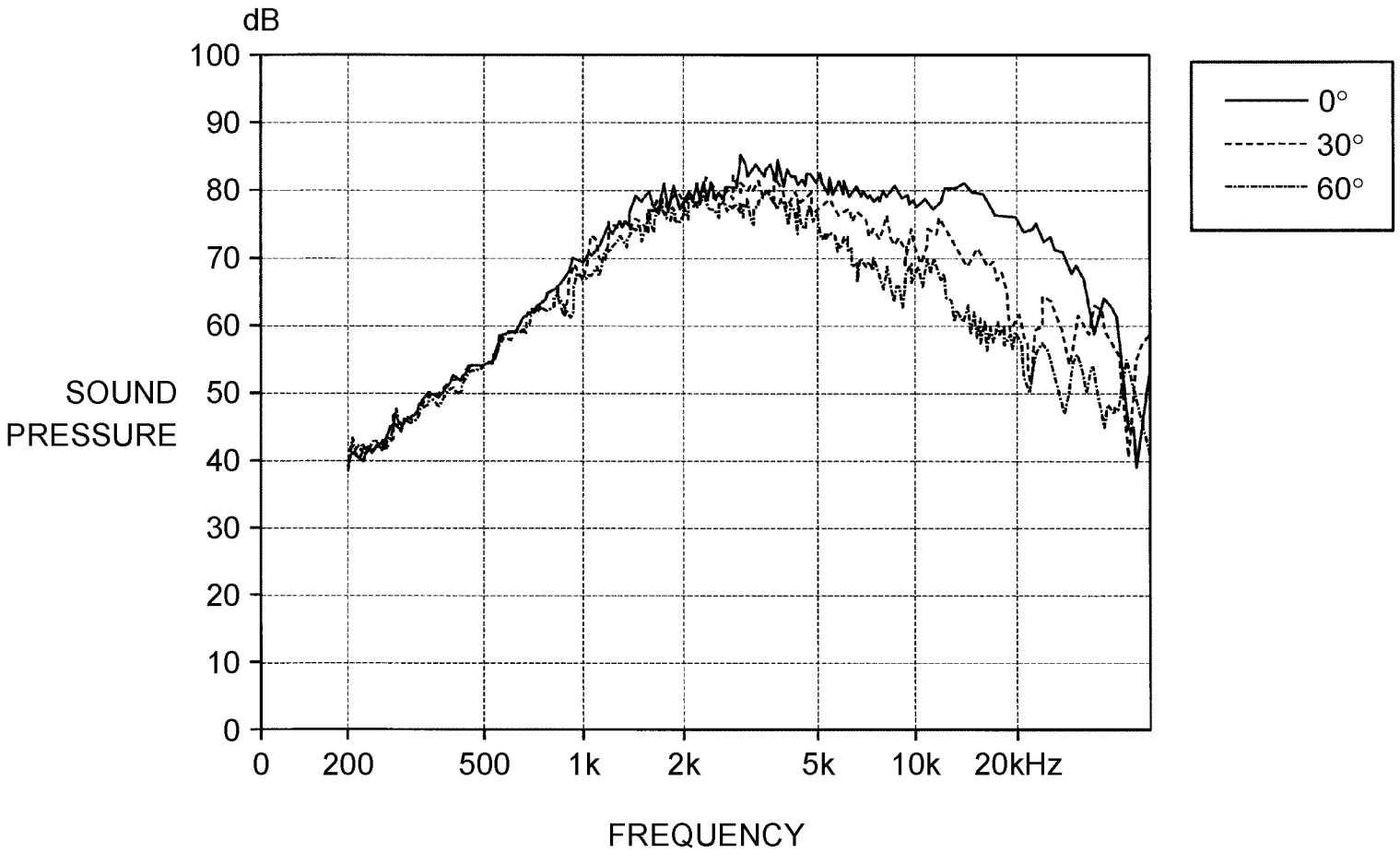
FIG. 11 is a diagram illustrating acoustic characteristics of the tweeter in a case where the acoustic lens is not mounted.
Figure 12:
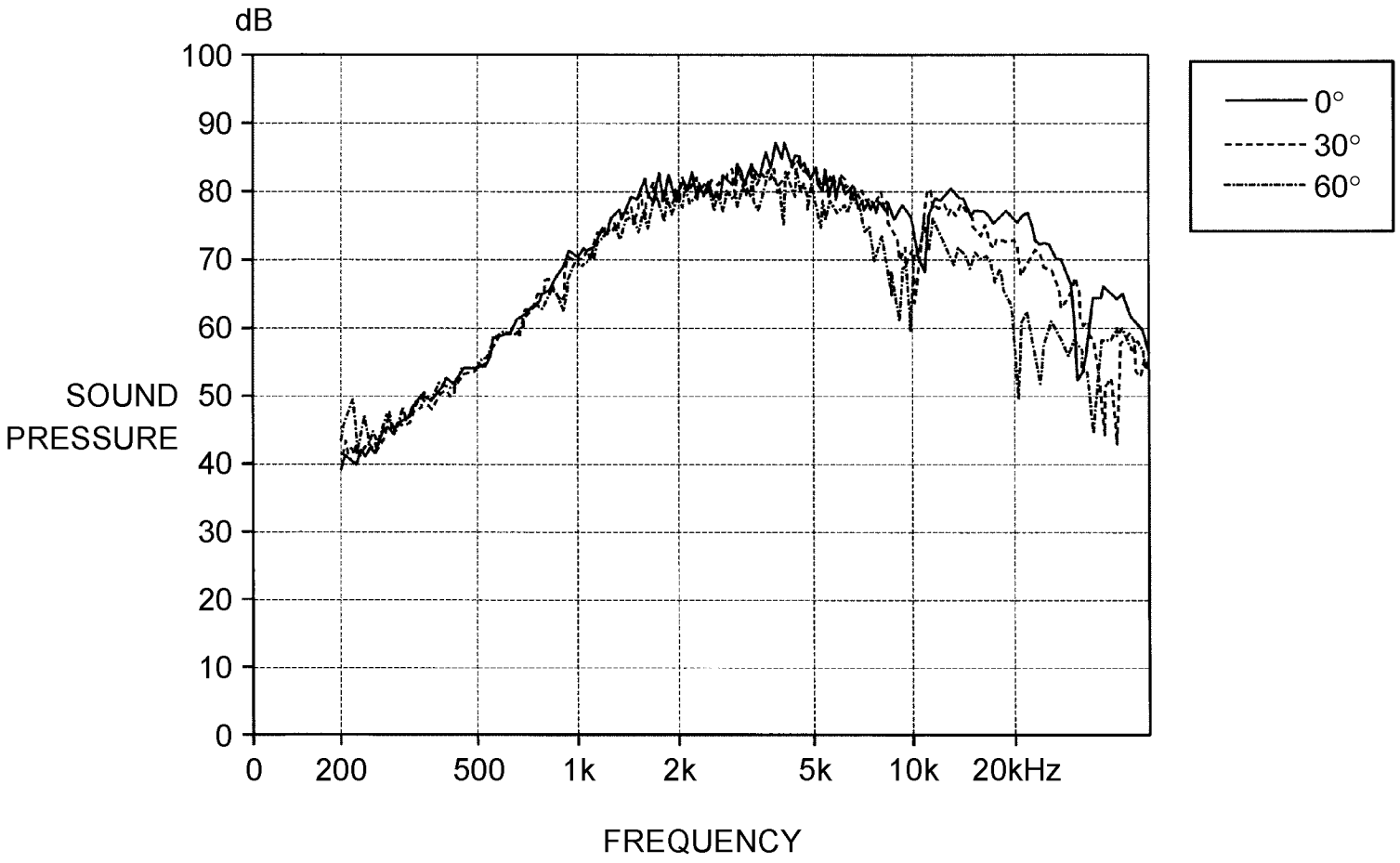
FIG. 12 is a diagram illustrating acoustic characteristics of the tweeter in a case where the acoustic lens is mounted.

FIG. 11 is a diagram illustrating acoustic characteristics in a case where the acoustic characteristics are measured without mounting the acoustic lens on the speaker. FIG. 12 is a diagram illustrating acoustic characteristics in a case where the acoustic characteristics are measured in a state where the acoustic lens is mounted on the speaker. In each of FIG. 11 and FIG. 12, a solid line indicates a result of measuring the acoustic characteristics at a front position (0° position) of the speaker. A broken line indicates a result of measuring the acoustic characteristics at a position shifted by 30° from the front face of the speaker in the horizontal direction and outward. A dot-and-dash line indicates a result of measuring the acoustic characteristics at a position shifted by 60° from the front face of the speaker in the horizontal direction and outward.

It can be seen that, in a case where the acoustic lens is not mounted (refer to FIG. 11), a sound pressure at a 30° position is attenuated more than a sound pressure at the front position)(0°) in a high frequency range (of 11 kHz or more in particular). Moreover, a larger attenuation than the attenuation at the 30° position is observed at the 60° position.

In contrast, it can be understood that, in a case where the acoustic lens according to the present exemplary embodiment is mounted (refer to FIG. 12), attenuation amounts at the 30° position and the 60° position are reduced as compared to the case where the acoustic lens is not mounted (refer to FIG. 11) in the high frequency range.

Figure 13:
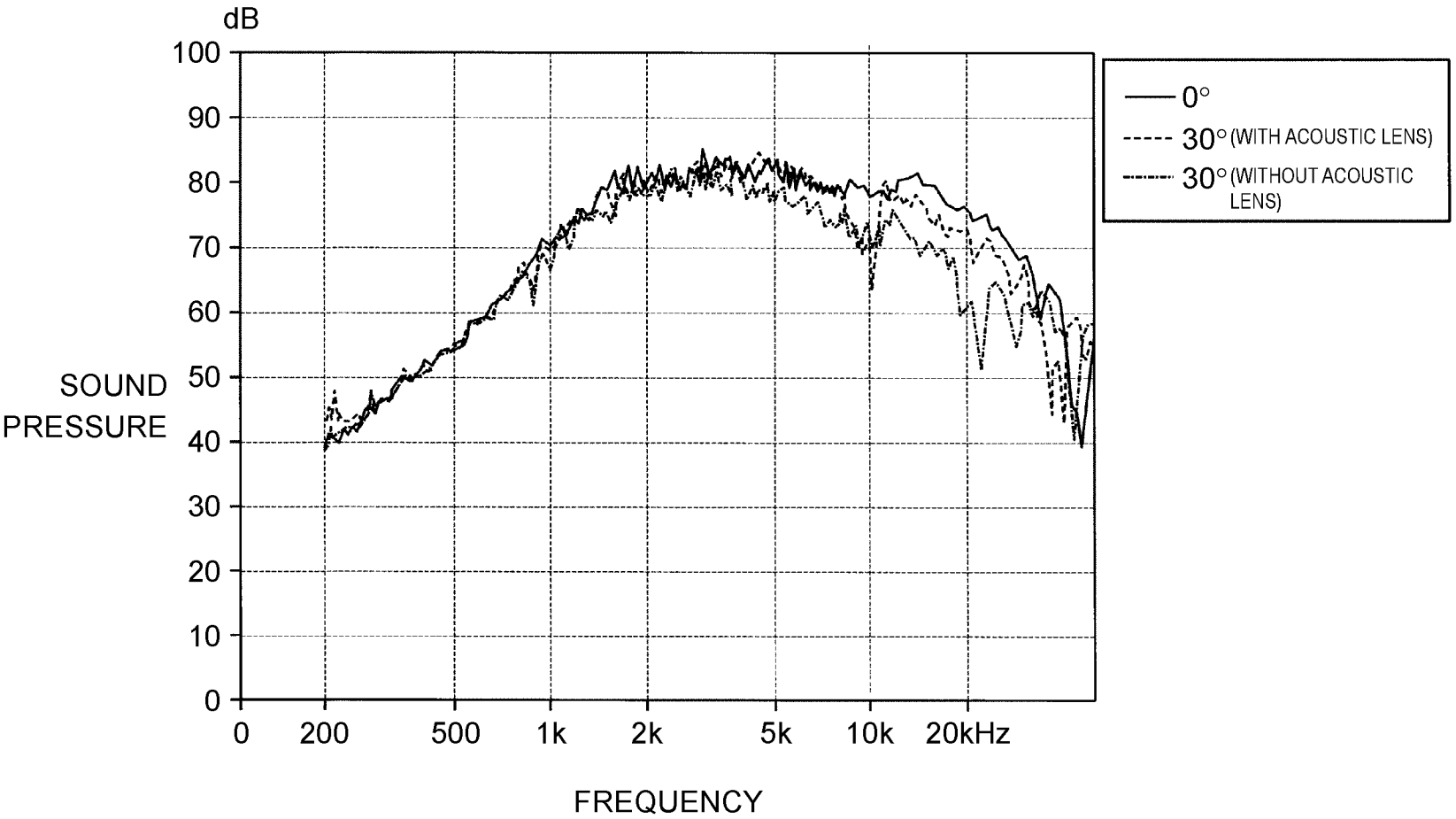
FIG. 13 is a diagram illustrating acoustic characteristics of the tweeter at a position of 30° from front.

FIG. 13 is a diagram illustrating the acoustic characteristics at the position shifted by 30° from the front face of the speaker. In FIG. 13, a broken line indicates a result of measuring the acoustic characteristics at the position shifted by 30° from the front face of the speaker in a state where the acoustic lens is mounted on the speaker. A dot-and-dash line indicates a result of measuring the acoustic characteristics at the position shifted by 30° from the front face of the speaker in a state where the acoustic lens is not mounted on the speaker. A solid line is data for comparison, and indicates the result of measuring the acoustic characteristics on the front face (that is, the 0° position) of the speaker.

Referring to FIG. 13, it can be seen that the sound pressure at the position shifted by 30° from the front face)(0°) is attenuated more than the sound pressure on the front face)(0°) regardless of whether the acoustic lens may be mounted. However, it can be understood that the attenuation amount is reduced in the case where the acoustic lens is mounted as compared to the case where the acoustic lens is not mounted.

Figure 14:
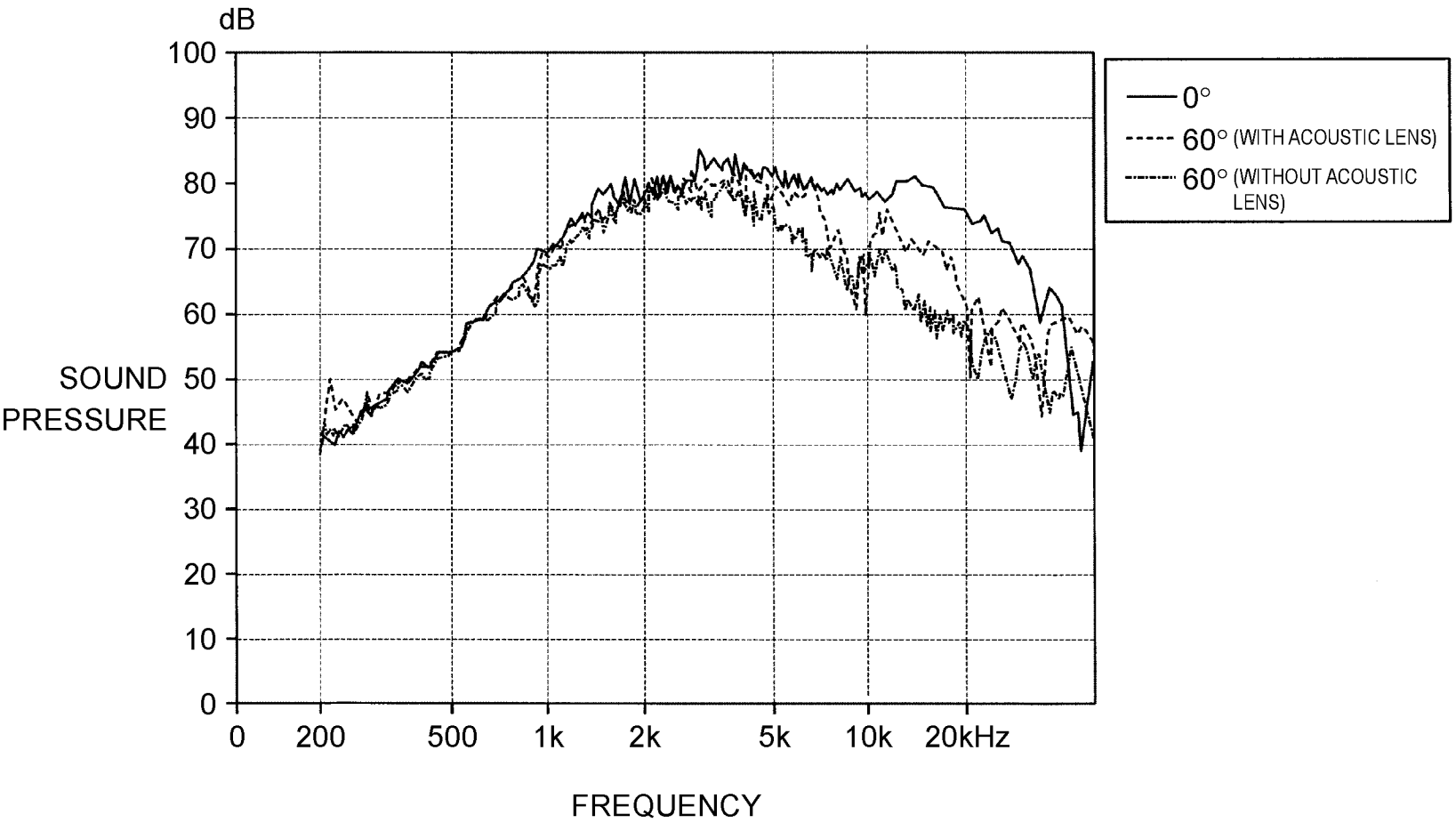
FIG. 14 is a diagram illustrating acoustic characteristics of the tweeter at a position of 60° from front.

FIG. 14 is a diagram illustrating the acoustic characteristics at the position shifted by 60° from the front face of the speaker. In FIG. 14, a broken line indicates a result of measuring the acoustic characteristics at the position shifted by 60° from the front face of the speaker in the state where the acoustic lens is mounted on the speaker. A dot-and-dash line indicates a result of measuring the acoustic characteristics at the position shifted by 60° from the front face of the speaker in the state where the acoustic lens is not mounted on the speaker. A solid line is data for comparison, and indicates the result of measuring the acoustic characteristics on the front face (that is, the 0° position) of the speaker.

Referring to FIG. 14, it can be seen that the sound pressure at the position shifted by 60° from the front face)(0°) is attenuated more than the sound pressure on the front face)(0°) regardless of whether the acoustic lens may be mounted. However, it can be understood that the attenuation amount is reduced in the case where the acoustic lens is mounted as compared to the case where the acoustic lens is not mounted.

As described above, as seen from FIG. 11 to FIG. 14, even at the position shifted from the front face of the speaker, a high sound pressure level is achieved at a high frequency (for example, 11 kHz or more) by the acoustic lens according to the present exemplary embodiment. That is, the acoustic lens according to the present exemplary embodiment can expand the propagation range of the sound from the speaker in the horizontal direction.

1-3. Louver

Figure 15:
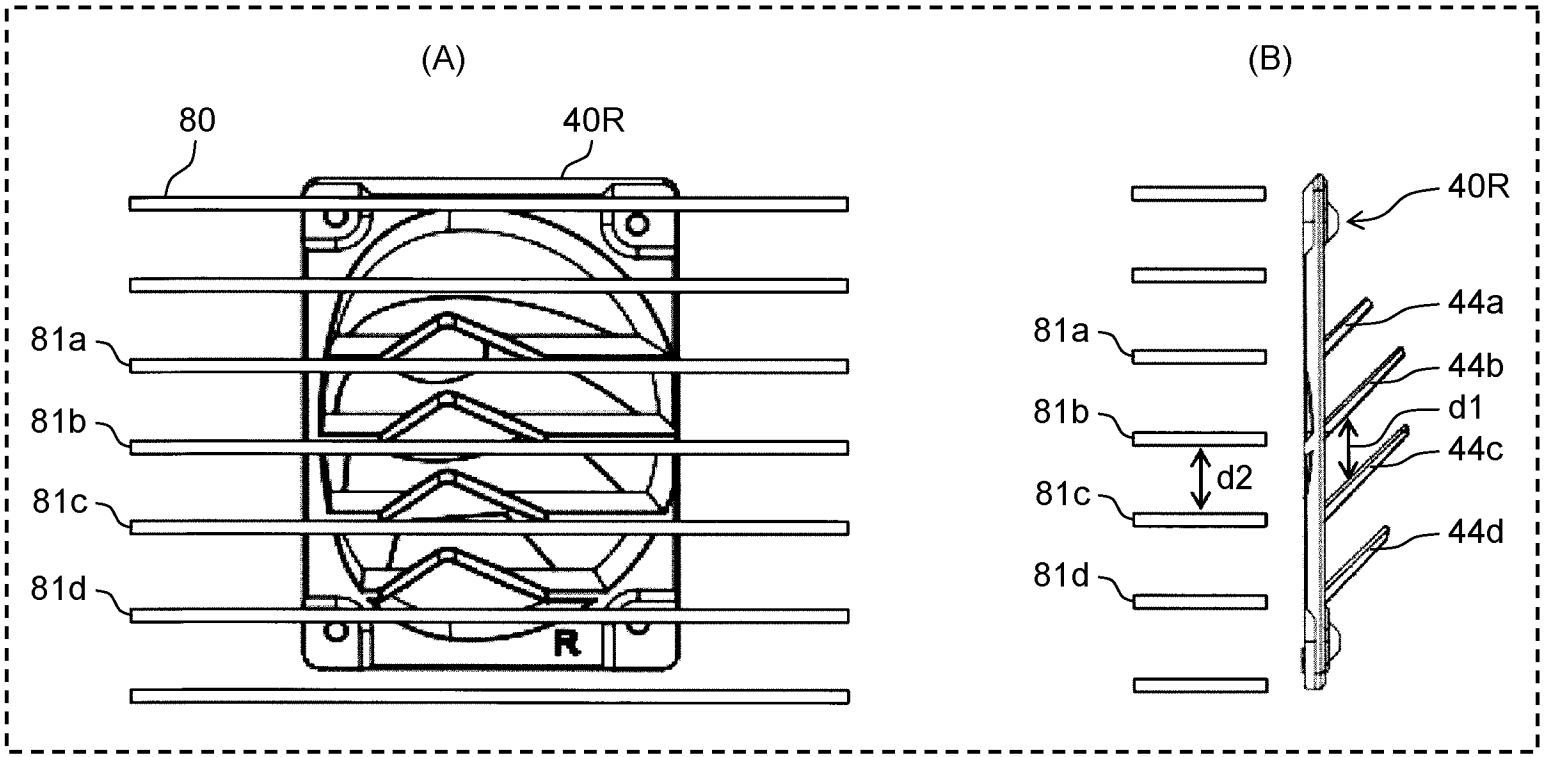
FIG. 15 show views describing a relationship between the louver and the acoustic lens.

Hereinafter, louver 80 attached to the front face of speaker system 100 will be described. FIG. 15 show views illustrating a relationship between fins 44*a* to 44*d* of acoustic lens 40R and louver boards 81*a* to 81*b* of louver 80. As illustrated in FIG. 15, an interval d1 between fins 44*a* to 44*d* of each of acoustic lenses 40R and 40L and an interval d2 between louver boards 81*a* to 81*b* of louver 80 are set equal to each other. In this way, a reflection that occurs between louver boards 81*a* to 81*b* and fins 44*a* to 44*d* of the acoustic lens is less likely to occur. Moreover, an acoustic loss caused by a change of a size of the sound path is less likely to occur. Hence, the sound output from acoustic lens 40R is smoothly output to the outside of speaker system 100 from spaces between louver boards 81*a* to 81*d* of the louver. That is, an influence to the acoustic characteristics by louver 80 can be reduced, and smooth reproduction of the sound is realized.

Figure 16:
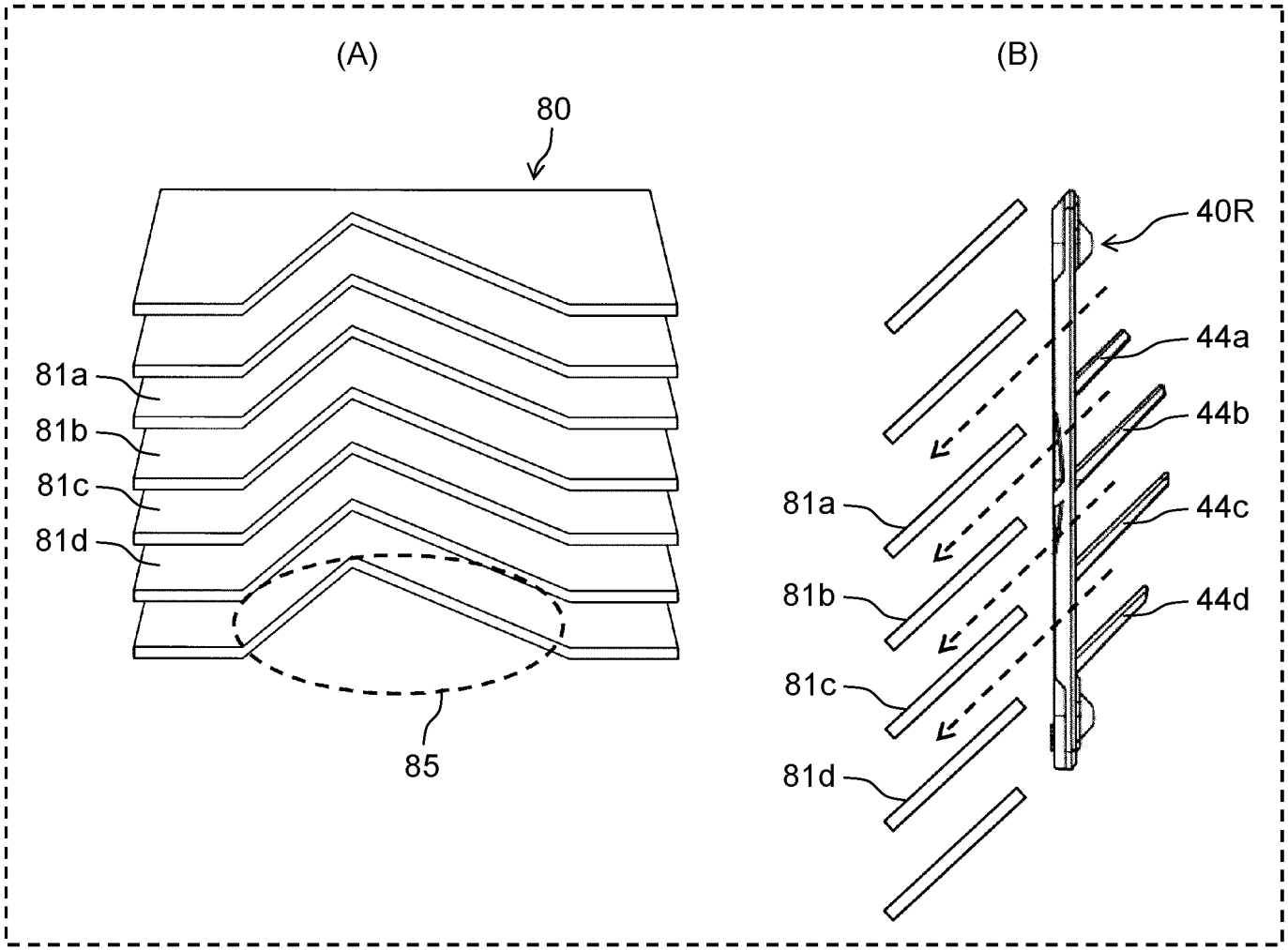
FIG. 16 show views illustrating another configuration example of the louver.

FIG. 16 show views illustrating another configuration example of louver 80. FIG. 16 illustrates only a portion of louver 80 disposed for tweeter 30R. A part (A) of FIG. 16 is a view of louver 80 with another configuration when viewed from front. A part (B) of FIG. 16 is a view of louver 80 with another configuration when viewed from a right side (that is, a right side when the speaker system is viewed from front).

As illustrated in the part (A) of FIG. 16, notch portions 85 are formed in portions of louver boards 81*a* to 81*d* of louver 80, the portions facing tweeter 30R. Moreover, as illustrated in the part (B) of FIG. 16, an angle of louver boards 81*a* to 81*b* is set to the same angle as an angle of fins 44*a* to 44*d* of acoustic lens 40R. Louver 80 is configured as described above, whereby lengths of paths of sounds passing through louver boards 81*a* to 81*d* can be varied, and louver 80 can also be caused to function as an acoustic lens. That is, louver 80 that has such a configuration can realize the function of the acoustic lens together with acoustic lens 40R, and can further expand the propagation range of the sound.

Figure 17:
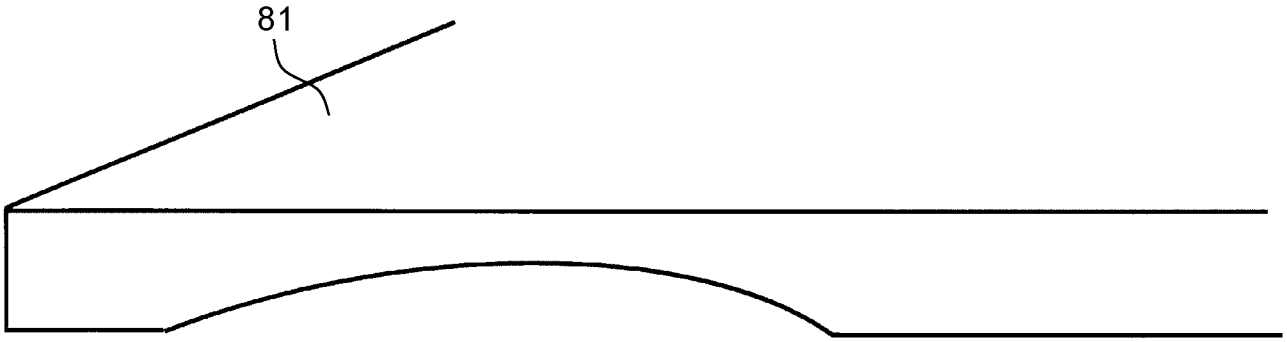
FIG. 17 is a view illustrating still another configuration example of the louver.

Note that, as a method of causing louver 80 to function as the acoustic lens, a thickness of the louver boards of louver 80 may be varied depending on locations in place of or in addition to providing the notch portions and differentiating the length of the paths. That is, a thickness of regions where acoustic resistance is desired to be increased (for example, on the outside in the horizontal direction of the speaker system) only needs to be increased. The louver boards can be acoustic resistance in the propagation of the sound, and accordingly, a degree of the resistance changes by changing the thickness. Hence, a velocity of the sound can be changed by the thickness when the sound is caused to pass through the louver boards. For example, as illustrated in FIG. 17, the thickness of louver board 81 of louver 80 may be varied in accordance with a position in the longitudinal direction (that is, the horizontal direction) of louver board 81.

Figure 18:
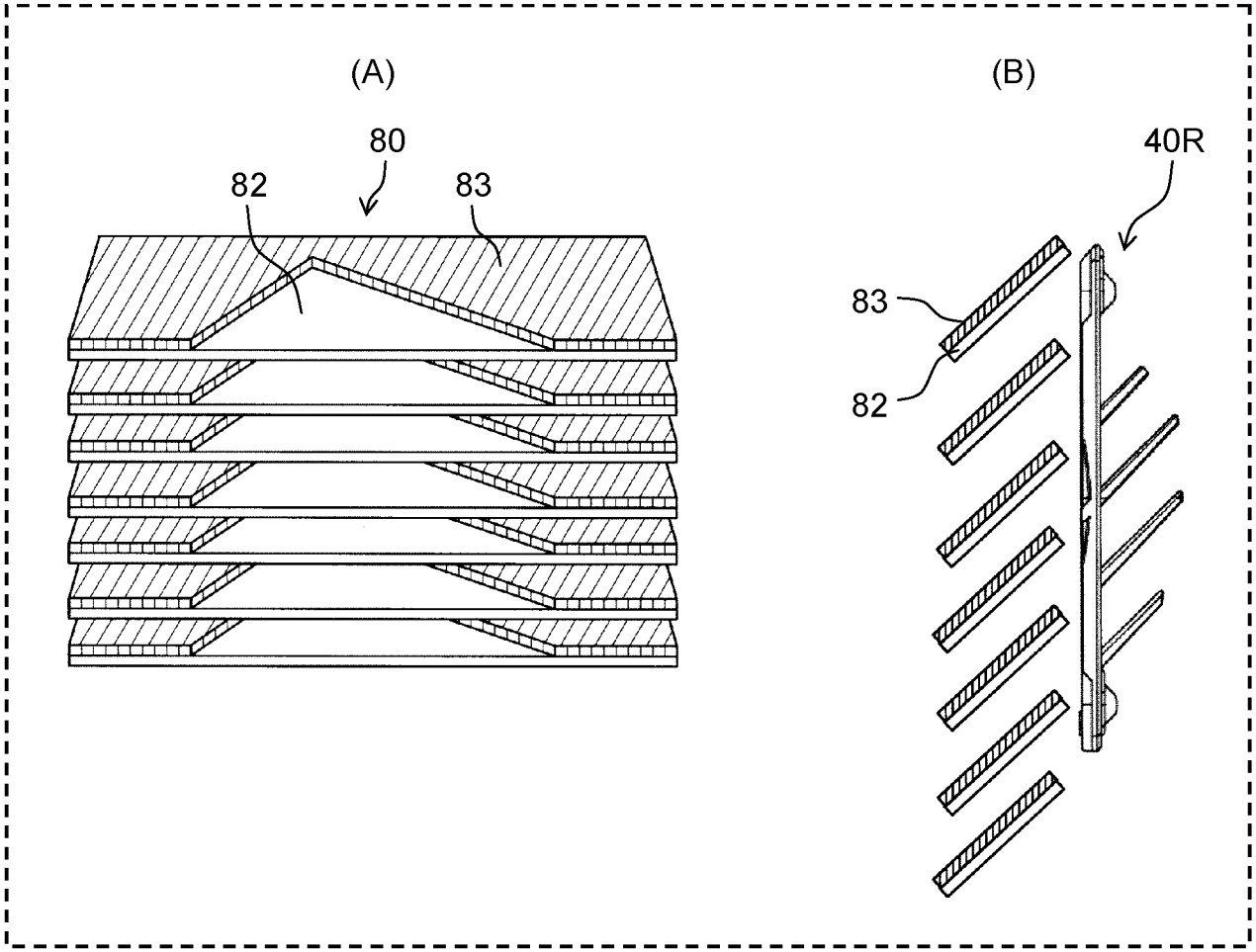
FIG. 18 show views illustrating yet another configuration example of the louver.

Moreover, as illustrated in FIG. 18, material 83 such as nonwoven fabric that generates acoustic resistance may be pasted on one surface of each louver board 82. Moreover, materials 83 may be pasted on both surfaces of each louver board 82. That is, material 83 only needs to be pasted on a region where acoustic resistance is desired to be increased (for example, the outside in the horizontal direction of the speaker system). From the above, the thickness of louver boards 81 or a shape or pasted positions of materials 83 only needs to be set in accordance with desired acoustic resistance.

1-4. Effects and Others

As described above, each of acoustic lenses 40L, 40R according to the present exemplary embodiment is an acoustic lens that adjust the directivity of the sound emitted from each of tweeters 30L, 30R (an example of the speaker). Each of acoustic lenses 40L, 40R includes the plurality of fins 44*a* to 44*d* arranged at a predetermined interval. At least one fin (fin 44*b* and fin 44*c*) of the plurality of fins 44*a* to 44*d* includes: notch portion 45 (an example of a first notch portion) provided on a front side of the path of the sound (an example of a first notch portion); and notch portion 46*b*, 46*c* (an example of a second notch portion) formed on the rear side of the path of the sound in accordance with the shape of the diaphragm of the speaker, which is disposed in proximity to the fin, on the rear of the path of the sound.

Notch portions 46*b*, 46*c* are provided on the rear side of fins 44*b*, 44*c*, whereby it is possible to bring fins 44*b*, 44*c* closer to diaphragm 32 of the speaker. Hence, even in a case where a space for installing the fins is small, the fins can be extended to the proximity of the diaphragm of the speaker, and it is possible to lengthen the paths by the fins. In this way, even in the case where the space for installing the fins is small, the controllable frequency can be shifted to a lower range.

Fins 44*a* to 44*d* are arranged parallel to a direction perpendicular to the longitudinal direction of the fins. The shape of fins 44*a* to 44*d* is asymmetrical in the longitudinal direction of fins 44*a* to 44*d*. That is, fins 44*a* to 44*d* are eccentric fins. In this way, mutually different lens effects are given in a lateral direction of the speaker. Hence, the listening area can be expanded more outward in the horizontal direction of speaker system 100.

Rear notch portions 46*b*, 46*c* are formed to match with at least one of the curved surface that constitutes the outer diameter of diaphragm 32 of the tweeter disposed behind the fins and of the inclined surface of diaphragm 32 (refer to FIG. 9 and FIG. 10). In this way, it is possible to extend the fins to the proximity of the diaphragm of the speaker. As a result, the path for giving the lens effect can be lengthened, and the controllable frequency can be shifted to a lower range.

Moreover, the present exemplary embodiment discloses the acoustic lens that adjust the directivity of the sound emitted from the speaker, the acoustic lens including the plurality of fins 44*a* to 44*d* arranged at a predetermined interval. The plurality of fins are arranged parallel to the direction perpendicular to the longitudinal direction of the fins. In each of fins 44*a* to 44*d*, notch portion 45 is formed on the front side of the path of the sound. The shape of each of fins 44*a* to 44*d* is asymmetrical in the longitudinal direction of the fin. In this way, the sound can be further diffused on one end side in the longitudinal direction of the fin.

Moreover, speaker system 100 (an example of a speaker device) according to the present exemplary embodiment includes: tweeters 30L, 30R (examples of speakers) which output the sounds; and acoustic lenses 40L, 40R disposed on the paths of the sounds emitted from the tweeters.

Speaker system 100 further includes louver 80 attached with louver boards 81*a* to 81*d*. Louver boards 81*a* to 81*d* are arranged at a predetermined interval in the thickness direction of the louver boards. The interval between louver boards 81*a* to 81*d* and the interval between fins 44*a* to 44*d* of the acoustic lens are equal to each other. In this way, the sounds from speaker system 100 are caused to smoothly propagate to the outside of speaker system 100.

Notch portion 85 may be provided in the front portion of each of louver boards 81*a* to 81*d* in the path of the sound. In this way, louver 80 can function as the acoustic lens together with acoustic lenses 40L, 40R.

The inclination angle of louver boards 81*a* to 81*d* in louver 80 and the inclination angle of fins 44*a* to 44*d* may be equal to each other. In this way, louver 80 can function as the acoustic lens together with acoustic lenses 40L, 40R.

The thickness of louver boards in louver 80 may vary in accordance with the positions in the longitudinal direction of louver boards 81*a* to 81*d* (refer to FIG. 17). In this way, louver 80 can function as the acoustic lens together with acoustic lenses 40L, 40R.

Acoustic lenses 40L, 40R are provided for tweeters 30L, 30R. The acoustic lenses are applied to tweeters 30L, 30R which output high-frequency sounds having strong directivity, whereby the directivity at the high frequency can be improved.

Other Exemplary Embodiments

The first exemplary embodiment has been described above as an example of the technique disclosed in the present application. However, the technique according to the present disclosure is not limited to the first exemplary embodiment, but is applicable to other exemplary embodiments including appropriate modifications, replacements, additions, omissions, and the like. It is also possible that constituent elements described in the above first exemplary embodiment are combined to create a new exemplary embodiment. Accordingly, other exemplary embodiments will be described below.

In the first exemplary embodiment, the number of fins 41*a* to 41*d* in each of acoustic lenses 40L, 40R is set to four; however, the number of fins is not limited to this. The acoustic lens may include an arbitrary number of fins.

In the above exemplary embodiment, notch portions 46*b*, 46*c* are provided on the rear side of only fins 41*b*, 41*c* which are the second and the third from the top. However, the fins provided with the notch portions on the rear side are not limited to the fins at these positions. Whether or not the notch portions are to be provided on the rear side only needs to be determined based on a positional relationship between the fins and the diaphragm of the speaker.

The shape of the notch portions provided on the acoustic lens is not limited to that disclosed in the first exemplary embodiment. An arbitrary shape (for example, a rectangular shape, a circular arc shape) is adopted as long as the shape is a shape that allows a change of the length of the sound path (that is, the velocity of the sound).

Speaker system 100 according to the present exemplary embodiment is a 3-way speaker system including three types of the speakers different in audio frequency; however, the acoustic lens according to the present exemplary embodiment is not limited to this. The acoustic lens according to the present exemplary embodiment is also applied to a 2-way speaker system.

The exemplary embodiments have been described above as examples of the technique in the present disclosure. For that purpose, the accompanying drawings and detailed descriptions have been provided.

Hence, the constituent elements described in the accompanying drawings and the detailed description may include not only the constituent elements essential for solving the problem but also constituent elements that are not essential for solving the problem in order to illustrate the technique. For this reason, even if these unessential constituent elements are described in the accompanying drawings and the detailed description, these unessential constituent elements should not be immediately approved as being essential.

Moreover, since the above exemplary embodiments illustrate the technique in the present disclosure, various modifications, substitutions, additions and omissions can be performed within the scope of claims and equivalent scope of claims.

INDUSTRIAL APPLICABILITY

The present disclosure is useful for the acoustic lens that adjusts the directivity of the sound and for the speaker device that outputs the sound. For example, the present disclosure is useful for a compact speaker device that cannot ensure an interval between speakers of right and left channels.

REFERENCE MARKS IN THE DRAWINGS

30L, 30R: tweeter
40L, 40R: acoustic lens
41: opening
42: frame
43: screw hole
44*a* to 44*d*: fin
45: notch portion
46*b*, 46*c*: notch portion
50L, 50R: midrange speaker
70: woofer
80: louver
81, 81*a* to 81*d*, 82: louver board
83: material
100: speaker system

The invention claimed is:

1. An acoustic lens that adjusts directivity of a sound emitted from a speaker, the acoustic lens comprising:
a plurality of fins arranged at a predetermined interval, wherein each fin of the plurality of the fins has a flat plate shape and a first fin that is one of the plurality of fins at least includes:
a first notch portion provided on a front side of a path of the sound; and
a second notch portion provided on a rear side of the path of the sound and having a shape corresponding to a shape of a diaphragm of the speaker, the diaphragm being disposed in proximity to the first fin, wherein
the plurality of fins are arranged parallel to a direction perpendicular to a longitudinal direction of the plurality of fins, and
respective shapes of the plurality of fins are asymmetrical in the longitudinal direction.

2. The acoustic lens according to claim 1, wherein
the diaphragm is disposed behind the first fin, and
the shape of the second notch portion corresponds to at least one of a curved surface constituting an outer diameter of the diaphragm and an inclined surface of the diaphragm.

3. An acoustic lens that adjusts directivity of a sound emitted from a speaker, the acoustic lens comprising:
a plurality of fins arranged at a predetermined interval, wherein the plurality of fins are arranged parallel to a direction perpendicular to a longitudinal direction of the plurality of fins, and
a notch portion is formed on a front side of a path of the sound in each of the plurality of fins, and
a shape of each of the plurality of fins is asymmetrical in the longitudinal direction.

4. A speaker system comprising:
a speaker;
an acoustic lens that adjusts directivity of sound emitted from the speaker, wherein the acoustic lens is disposed in a path of the sound emitted from the speaker and the acoustic lens includes:
a plurality of fins arranged at a predetermined interval, wherein each fin of the plurality of the fins has a flat plate shape and a first fin that is one of the plurality of fins at least includes:
a first notch portion provided on a front side of a path of the sound; and
a second notch portion provided on a rear side of the path of the sound and having a shape corresponding to a shape of a diaphragm of the speaker, the diaphragm being disposed in proximity to the first fin; and
a louver attached to a plurality of louver boards, wherein the plurality of louver boards are arranged at a predetermined interval in a thickness direction of the plurality of louver boards, and
the interval between the plurality of louver boards and the interval between the plurality of fins are equal to each other.

5. The speaker system according to claim 4, wherein a notch portion is provided on a front side of the path of the sound in each of the plurality of louver boards.

6. The speaker system according to claim 5, wherein an inclination angle of the plurality of louver boards and an inclination angle of the plurality of fins are equal to each other.

7. The speaker system according to claim 4, wherein a thickness of each of the plurality of louver boards varies in accordance with a position in a longitudinal direction of each of the plurality of louver boards.

8. An acoustic lens that adjusts directivity of a sound emitted from a speaker, the acoustic lens comprising:
a plurality of fins arranged at a predetermined interval, wherein a first fin that is one of the plurality of fins at least includes:
a first notch portion provided on a front side of a path of the sound, and
a second notch portion provided on a rear side of the path of the sound and having a shape corresponding to a shape of a diaphragm of the speaker, the diaphragm being disposed in proximity to the first fin, and wherein
the plurality of fins are arranged parallel to a direction perpendicular to a longitudinal direction of the plurality of fins, and
respective shapes of the plurality of fins are asymmetrical in the longitudinal direction.

9. A speaker system comprising:
an acoustic lens that adjusts directivity of a sound emitted from a speaker, the acoustic lens comprising:
a plurality of fins arranged at a predetermined interval, wherein a first fin that is one of the plurality of fins at least includes:
a first notch portion provided on a front side of a path of the sound, and
a second notch portion provided on a rear side of the path of the sound and having a shape corresponding to a shape of a diaphragm of the speaker, the diaphragm being disposed in proximity to the first fin;
the speaker that outputs the sound, wherein the acoustic lens is disposed on the path of the sound emitted from the speaker; and
a louver attached with a plurality of louver boards, wherein
the plurality of louver boards are arranged at a predetermined interval in a thickness direction of the plurality of louver boards, and
the interval between the plurality of louver boards and the interval between the plurality of fins are equal to each other.

10. The speaker system according to claim 9, wherein a notch portion is provided on a front side of the path of the sound in each of the plurality of louver boards.

11. The speaker system according to claim 10, wherein an inclination angle of the plurality of louver boards and an inclination angle of the plurality of fins are equal to each other.

12. The speaker system according to claim 9, wherein a thickness of each of the plurality of louver boards varies in accordance with a position in a longitudinal direction of each of the plurality of louver boards.

* * * * *